US007010093B2

(12) United States Patent
Lenz et al.

(10) Patent No.: US 7,010,093 B2
(45) Date of Patent: Mar. 7, 2006

(54) HIGH-CAPACITY X-RAY TUBE

(75) Inventors: Eberhard Lenz, Erlangen (DE); Peter Rother, deceased, late of Baiersdorf (DE); by Jutta Rother, legal representative, Baiersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/820,914

(22) Filed: Apr. 8, 2004

(65) Prior Publication Data

US 2004/0252808 A1 Dec. 16, 2004

(30) Foreign Application Priority Data

Apr. 8, 2003 (DE) ..... 103 16 089

(51) Int. Cl.
*H01J 35/10* (2006.01)

(52) U.S. Cl. ..... 378/125; 378/144; 378/121

(58) Field of Classification Search ..... 378/125, 378/121, 144, 132, 128
See application file for complete search history.

(56) References Cited

U.S. PATENT DOCUMENTS 4,736,400 A * 4/1988 Koller et al. ..... 378/125
6,213,639 B1 4/2001 Hell et al.
6,567,500 B1 * 5/2003 Rother ..... 378/140
6,819,742 B1 * 11/2004 Miller ..... 378/144

FOREIGN PATENT DOCUMENTS

| | | |
|---|---|---|
| AT | 168037 | 9/1950 |
| DE | 7609467 | 4/1979 |
| DE | 100 17 777 | 10/2001 |
| JP | 01221845 | 9/1989 |

OTHER PUBLICATIONS

Metall, Heinrich (1990) pp. 384 and 390.

* cited by examiner

*Primary Examiner*—Edward J. Glick
*Assistant Examiner*—Elizabeth Keaney
(74) *Attorney, Agent, or Firm*—Schiff Hardin LLP

(57) ABSTRACT

A high-capacity x-ray tube particularly for use in medical technology in CT apparatuses, has a vacuum housing containing a cathode and a rotatably mounted anode. The anode plate of the anode is connected by a solder connection to the one end of a load-bearing part, the other end of which is attached to the bearing shaft of a drive for placing the anode in rotation. The mechanical strength of the connection location between the anode plate and the load-bearing part is improved by the connection being formed by a positive fit, designed such that the connection surfaces are subjected substantially only to compression given rotation of the anode.

7 Claims, 2 Drawing Sheets

HIGH-CAPACITY X-RAY TUBE

BACKGROUND OF THE INVENTION

1. Field of the Invention

The present invention concerns a high-capacity x-ray tube of the type having a rotating anode 2. Description of the Prior Art High-capacity x-ray tubes as used, for example, in medical technology in CT systems occasionally are fashioned as rotating piston tubes, but mostly are fashioned as rotating anode tubes. In rotating piston tubes (such as, for example, specified in German OS 198 43 649) the anode is firmly connected with the rotatable tube piston (i.e., piston shaped vacuum housing), so the anode and cathode rotate together with the tube piston. In rotating anode tubes the cathode is fixed in the vacuum housing and the anode is rotatably arranged in the vacuum housing. By means of a suitable load-bearing part, the anode plate of the anode is attached to a bearing shaft that is rotatably mounted in the vacuum housing at bearings. The bearing shaft, and with it the anode plate, is rotated by means of an electro-actuator, for example by a squirrel-cage motor. The anode plate typically is composed of molybdenum with a coating of tungsten (W) or a W-alloy and a graphite plate soldered to it. Upon striking on the tungsten coating of the rotating anode plate, the electron beam originating from the stationary cathode generates an x-ray beam that can exit at an exit window in the vacuum housing. Such a rotating anode tube is described, for example, specified in German OS 100 17 777.

In newer versions, the load-bearing part that connects the anode plate with the bearing shaft is fashioned as a cylindrical or funnel-shaped component made of molybdenum. The attachment of anode plate to the load-bearing part ensues by a finely threaded screwed connection. After the assembly of these parts, the connection is soldered with a high-temperature solder, for example a zirconium solder. The molten solder reacts with the molybdenum of the components, resulting in an increase in the hardness of the solder. Tests have shown that the hardness values of the solder in the region of the load-bearing part drastically increase, in particular given higher capacity and therewith given stronger loading of the tube.

Examinations have furthermore shown that, during the operation of the x-ray tube to conduct scans of a subject, in each scan the outer region of the load-bearing part heats more significantly than the relatively cold location in the region of the solder connection. Given the design conditions of the aforementioned known versions, the load-bearing part (designated in the following as a "funnel", due to the funnel-shaped embodiment) is under tension given rotation of the anode plate, with the highest tensile stresses occurring in the region of the solder connection. The plate edge heats substantially more significantly than the solder location, accordingly, the plate edge tends to expand more significantly than the solder. The solder location is thus the site with the highest tensile stress, which results from the temperature difference between the focal path ring of the anode plate and the colder (by comparison) solder location on the funnel.

Because the solder connection in the known embodiments represents a rigid material connection, the tensile stresses are fully transferred by the solder. Due to the relatively brittle character of the solder material, these tensile forces can lead to crack formations in the solder and to a flaking away (crumbling) of solder particles given severe loading of the tube. Incidentally connected with this is a reduction of the lifetime, and with it a premature failure of the tube.

SUMMARY OF THE INVENTION

An object of the present invention is to provide a high-capacity x-ray tube of the initially cited type with which the mechanical strength of the connection point between anode plate and the load-bearing part is improved, and also with which the lifetime of the tube in operation can be increased.

This is inventively achieved in a high-capacity x-ray tube wherein the connection of the anode plate with the load-bearing part is implemented with a positive fit, with the connection being designed such that the connection surfaces are subjected only to compression given rotation of the anode.

In a preferred embodiment of the invention, the positive fit is produced by a clamp connection (clamping joint).

The positive fit alternatively can be produced by a screw connection.

A particularly good and durable connection can be achieved when an additional positive fit is formed by the solder connection according to a further embodiment of the invention. For this, the end of the load-bearing part facing the anode plate can have an inner edge that encompasses the anode plate, and the load-bearing part, in this area directed toward the bearing shaft, has a number of gradations, of which at least one produces the positive fit with the load-bearing part. A further gradation can form, with the inner edge of the anode plate, an acceptance space for the yet-to-be-introduced solder of the solder connection, which forms a further positive fit in the soldered state.

DESCRIPTION OF THE PREFERRED EMBODIMENTS

Figure 1:
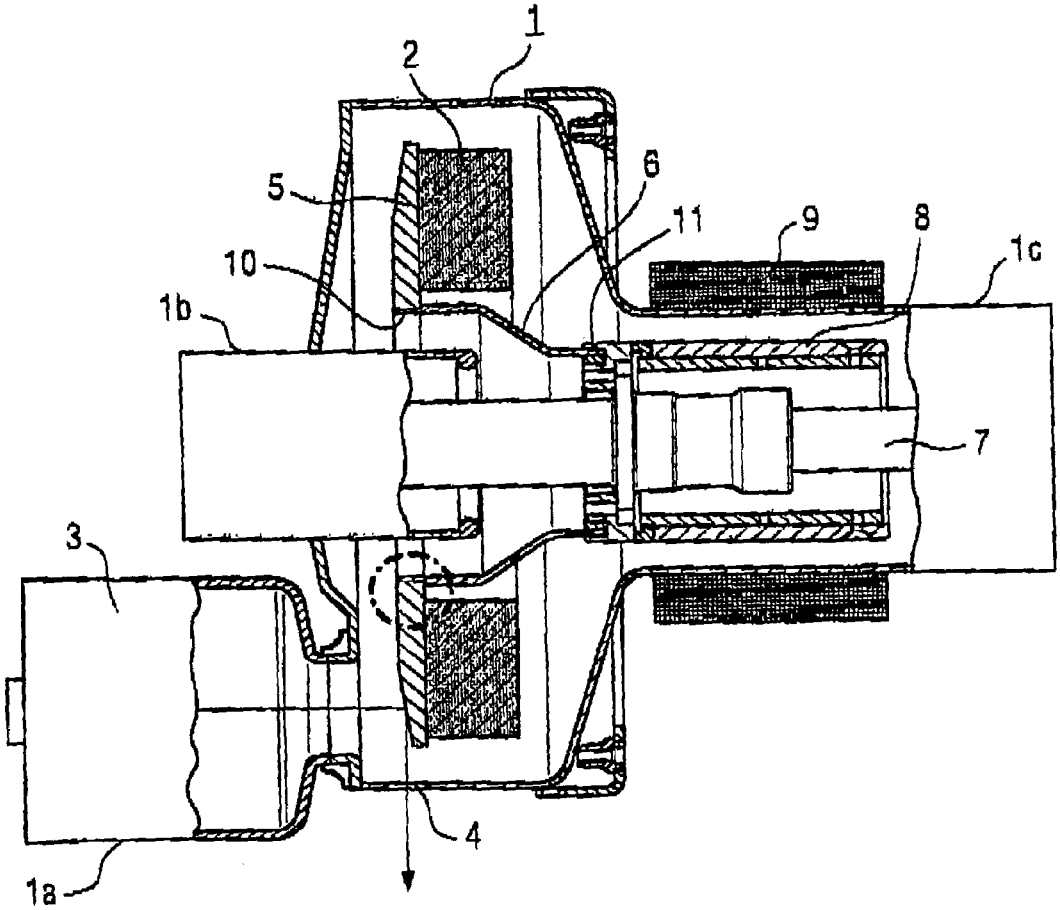
FIG. 1 is a schematic diagram of a high-capacity x-ray tube with a connection of anode plate and funnel according to the prior art, shown partially in longitudinal section.

In a somewhat simplified representation, FIG. 1 shows an embodiment of a known high-capacity x-ray tube. This x-ray tube has a vacuum housing 1 in which an anode 2 and a cathode arrangement 3 in a housing section 1*a* of the vacuum housing are controlled. Since the cathode arrangement is known and is not the subject matter of the invention, it need not be shown and explained in detail. It should merely to be noted at this point that the electron beam emitted by the cathode in the arrow direction strikes on the anode, and that the x-ray beam generated in the focal spot on the anode exits at an exit window 4 (see specified arrow in FIG. 1).

The rotatably mounted anode 2 has an anode plate 5 that is mounted fixed on a bearing shaft 7 by means of a funnel-shaped load-bearing part 6, designated in the following as a 'funnel'. The bearing shaft 7 is borne by means of suitable bearings (not shown) that are disposed in the housing sections 1*b* and 1*c*. In order to be able to place the anode 2 In rotation, a drive formed by a rotor 8 and a stator 9 is provided. The stator 9 is placed on the outer wall of the vacuum housing 1 in the region of the rotor 8.

The anode plate 5 is connected to the one end circumference of the funnel 6 via a screw/solder connection 10. The other end circumference of the funnel 6 is firmly connected to the bearing shaft 5 by suitable connection means 11. In this embodiment, the screw/solder connection 10 is comprised of mating fine threads respectively on the inner annular surface of the anode plate and the outer circumferential surface of the end of the funnel 6. The screwed connection is soldered with Zr solder after the assembly.

Such an embodiment has the disadvantages that the molten Zr solder reacts with the molybdenum of the adjacent components, which can lead to the previously described hardness increases, and the connection is strongly placed under tension given rotation of the anode plates.

Figure 2:
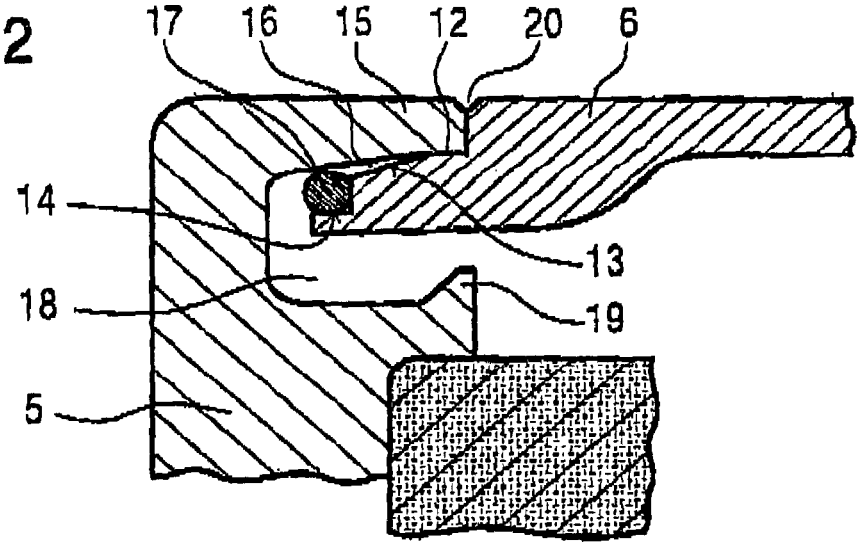
FIG. 2 is a section of the connection location of anode plate and funnel in a first embodiment according to the invention.

An improved connection of the anode plate 5 with the funnel 6 according to the invention is shown in FIG. 2. The section shown in enlarged representation in FIG. 2 is the region indicated in FIG. 1 with dash-dot lines.

In contrast to the screw/solder connection 10 employed in the prior art tube, a positive-fit clamp connection with soldering is inventively employed. The connection is designed such that the solder connection is no longer in operation subjected to tensile stress, but instead is subject to exclusively compression, given rotation of the anode plate. For this, the end circumference of the funnel 6 facing the anode plate 5 viewed toward the bearing shaft was a number of gradations 12, 13, 14, respectively increasingly reduced in diameter, which encompass an inner edge 15 of the anode plate 5. In the first upper gradation 12, a positive fit with a part of the edge 15 is achieved by clamping. The subsequent gradation 13 forms with the corresponding part of the edge 15 a space 16 having a wedge-shaped cross section. A solder ring 17 is disposed in the third, lower gradation 14. Upon heating of the solder ring 17, the solder inters into the space 16, whereby a further positive fit with the edge 15 is formed in the soldered state. The solder thus also quasi-forms a positive fit, but in operation of the tube the solder connection Is always stressed by compression and not by tensile stress, as in the prior art.

The edge 15 of the anode plate 5 is formed by an annular recess 18 that is dimensioned and designed to allow sufficient space to exist in which any leaking, excess solder or flaking solder particles can be caught. As can be seen from FIG. 2, the recess forming the space has for this purpose a raised edge 19. Excess solder also can be caught by bevels 20 preferably arranged on both sides on the inside of the funnel 6. The solder thus can remain in the solder surfaces.

Figure 3:
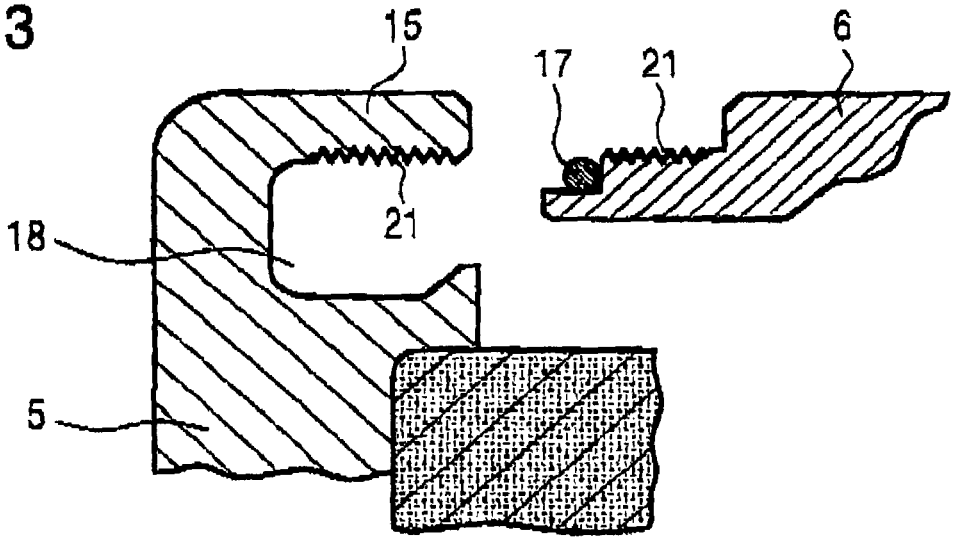
FIG. 3 is a section of the connection location as shown in FIG. 2, in a second embodiment according to the invention.

FIG. 3 shows a variant of the embodiment shown in FIG. 2. In place of the plug/clamp connection of the funnel 6 with the anode plate 5 in the region of the gradation 12 as a positive fit, in this variant the positive fit is produced by a screw connection 21. The gradation is here is only bi-level. It is assumed that no further positive fit via solder, as shown in the preceding example, is necessary with such a screwed connection. It is conceivable and within the framework of the invention, however, to also provide such a space in this variant.

Any suitable high-temperature solder can be used as solder material for the solder ring 10. Titanium (Ti) has proven to be particularly advantageous independent of the specific design.

Although modifications and changes may be suggested by those skilled in the art, it is the intention of the inventors to embody within the patent warranted hereon all changes and modifications as reasonably and properly come within the scope of their contribution to the art.

We claim as our invention:

1. A high-capacity x-ray tube comprising:

a vacuum housing;

a cathode stationarily mounted in said vacuum housing;

an anode rotatably mounted in said vacuum housing;

a drive for rotating said anode, said drive having a bearing shaft disposed in said vacuum housing;

said anode comprising an anode plate and a load-bearing part having a first end attached to said bearing shaft and a second end attached to said anode plate via a soldered connection between respective connection surfaces of said anode plate and said load bearing part, with said connection surfaces configured and oriented relative to each other to form a positive fit for causing said connection surfaces to be subject substantially only to compression upon rotation of said anode; and said connection surfaces comprising a first surface at said second end of said load-bearing part and a second surface formed by an inner annular edge of said anode plate, said first and second surfaces facing each other and, as viewed toward said bearing shaft, said first surface comprising a plurality of gradations, at least one of said gradations producing said positive fit and at least one further one of said gradations forming, with said second surface, an acceptance space for solder of said solder connection.

2. A high-capacity x-ray tube as claimed in claim 1 wherein said connection surfaces form a clamp connection as said positive fit.

3. A high-capacity x-ray tube as claimed in claim 1 wherein said connection surfaces form a screw connection as said positive fit.

4. A high-capacity x-ray tube as claimed in claim 1 wherein said solder connection contributes to said positive fit.

5. A high-capacity x-ray tube as claimed in claim 1 wherein said solder connection produces flaked solder particles, and wherein said connection surfaces form a recess for catching said solder particles.

6. A high-capacity x-ray tube as claimed in claim 5 wherein one of said connection surfaces is beveled to form said recess.

7. A high-capacity x-ray tube as claimed in claim 1 wherein said solder connection comprises titanium solder.

* * * * *